United States Patent [19]

Yasuhara

[11] Patent Number: 4,483,480

[45] Date of Patent: Nov. 20, 1984

[54] INJECTION VALVE TIMING SENSOR

[75] Inventor: Seishi Yasuhara, Yokosuka, Japan

[73] Assignee: Nissan Motor Company, Limited, Yokohama City, Japan

[21] Appl. No.: 231,599

[22] Filed: Feb. 5, 1981

[30] Foreign Application Priority Data

Feb. 13, 1980 [JP] Japan ..... 55-15483

[51] Int. Cl.[3] ..... B05B 1/30

[52] U.S. Cl. ..... 239/73; 239/533.3; 73/119 A; 73/754; 73/DIG. 4

[58] Field of Search ..... 73/119 A, 753, 754, 73/DIG. 4; 310/338, 365, 366, 348, 354, 355; 239/73, 533.3

[56] References Cited

U.S. PATENT DOCUMENTS

| | | | |
|---|---|---|---|
| 2,580,612 | 1/1952 | Schwarz et al. | 310/355 X |
| 3,146,360 | 8/1964 | Marshal | 310/338 X |
| 3,612,922 | 10/1971 | Furnival | 310/355 X |
| 3,728,562 | 4/1973 | Herson et al. | 310/355 X |

FOREIGN PATENT DOCUMENTS

| | | |
|---|---|---|
| 1942435 | 2/1970 | Fed. Rep. of Germany . |
| 2538381 | 3/1977 | Fed. Rep. of Germany . |
| 2739628 | 1/1979 | Fed. Rep. of Germany . |
| 43-59737 | 8/1968 | Japan . |
| 45-25505 | 3/1970 | Japan . |

*Primary Examiner*—John J. Love

*Attorney, Agent, or Firm*—Schwartz, Jeffery, Schwaab, Mack, Blumenthal & Koch

[57] ABSTRACT

A fuel injector has a lift sensor in the form of a cylindrical piezoelectric ceramic member having metal film electrodes on each side thereof and which is sandwiched between an insulated terminal element having a flat surface abutting one side of the piezoelectric element and a flat ground plate formed with projections which projections engage the wall of a bore in which the piezoelectric element is disposed so as to both hold the element in place and establish an electrical connection between the housing in which the bore is formed and the second side of the piezoelectric element. A spacing shim having a flat surface abutting the ground plate engages one end of a spring which biases the valve element of the fuel injector toward a closed position.

6 Claims, 11 Drawing Figures

INJECTION VALVE TIMING SENSOR

BACKGROUND OF THE INVENTION

1. Field of the Invention

The present invention relates generally to a fuel injector for an internal combustion engine and more particularly to a sensor which is disposed in the fuel injector for sensing the lift timing of the valve element thereof and outputting a signal indicating the injection timing.

2. Description of the Prior Art

In a known arrangement, a pressure sensitive piezoelectric element has been placed within the fuel injector in a manner to be subject to compression upon an opening movement of the needle valve or the like controlling the injection orifice of the injector nozzle, and thus functions as a lift or timing sensor. This piezoelectric element has been provided with a pair of lead lines which serve to establish an operative connection between the piezoelectric element and a control circuit utilized for varying the injection timing.

However, this arrangement suffers from the drawback that the provision of the lead lines complicates the construction of the arrangement to the point where it is difficult to apply force evenly over the surfaces of the element, which leads to cracking of same and the subsequent infiltration of fuel (e.g. diesel oil) into the regions where the lead wires are connected to the piezoelectric element. Further, breakage of one or both of the relatively fine lead wires as a result of injector and engine vibration is apt to occur, which renders the sensor inoperative and creates a situation where the output of the piezoelectric element is apt to short circuit and flow to the needle valve of the injector, break the fuel film between the valve and the associated portion of the injector valve (viz., the valve seat) and induce highly undesirable electrolytic corrosion of one or both of the needle valve and the valve seat.

Moreover, the complex construction involving the lead wires increases the time and trouble that must be taken during assembly and/or repair of the injectors, inducing unwanted increases in both production and maintenance costs.

SUMMARY OF THE INVENTION

The present invention features a ceramic button-like cylindrical piezoelectric element formed with highly conductive metal electrodes (e.g. silver) on each face. The piezoelectric element is disposed in a blind bore formed in the injector and is sandwiched between a terminal element and a ground plate. The terminal element is insulated from the body of the fuel injector and has a flat portion or member in contact with one of the piezoelectric element electrodes and is adapted to have a stem-like connection member sealingly and insulatingly disposed through the wall of the injector housing for connection to a suitable lead or the like. The ground plate has a very flat surface which contacts the other of the two electrodes of the piezoelectric element and is adapted to be press fitted into the bore to secure the piezoelectric element in place. The ground plate also establishes an electrical connection between the second of the piezoelectric element electrodes and the injector housing which accordingly serves as a second or ground terminal for an injection timing control circuit connected to the insulated connection member. Upon lifting of the injector needle valve, a spring between the needle valve and the ground plate compresses the piezoelectric element to induce the element to produce an output. The flat surfaces between which the piezoelectric element is sandwiched apply force uniformly thereto to prevent any tendency for the ceramic body of the piezoelectric element to crack.

BRIEF DESCRIPTION OF THE DRAWINGS

The features and advantages of the arrangement of the present invention will become more clearly appreciated from the following description taken in conjunction with the accompanying drawings in which like reference numerals denote corresponding elements, and in which.

DETAILED DESCRIPTION OF THE PREFERRED EMBODIMENT

Figure 1:
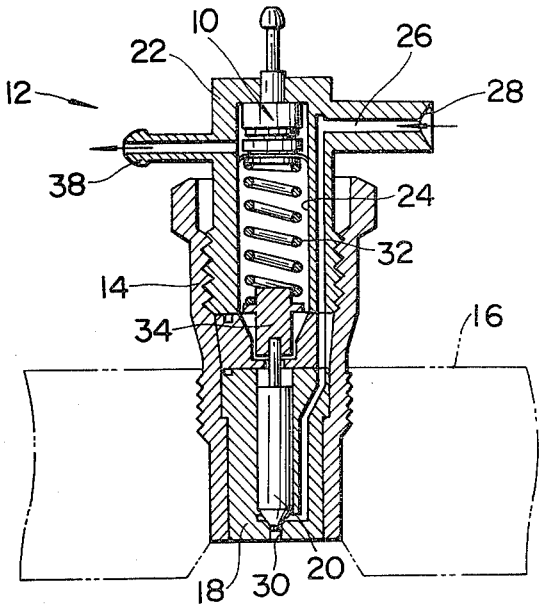
FIG. 1 is a sectioned elevational view of a fuel injector equipped with an injection timing or lift sensor according to the present invention.
Figure 2:
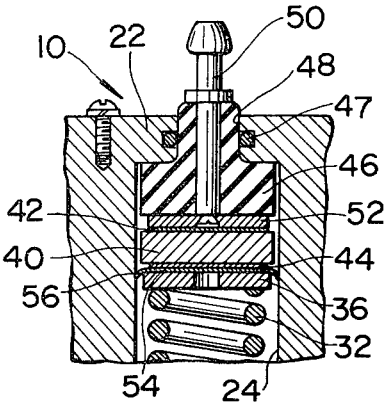
FIG. 2 is a enlarged view of a portion of FIG. 1, showing the arrangement of the sensor in detail.

Turning now to the figures, FIG. 1 shows a valve lift sensor 10 disposed in a fuel injector 12 which consists of a nozzle nut 14 threadedly engaged in an internal combustion engine cylinder head 16, an injection nozzle 18 disposed within the nozzle nut 14, which in turn has a needle valve 20 reciprocally disposed therein and a nozzle holder 22 threaded into the nozzle nut 14 for securing the nozzle 18 therein. The nozzle holder 22 is formed with a blind bore 24 in which the sensor 10 is disposed. The injector further includes a passage structure 26 formed through the nozzle holder 22 and the nozzle 18 for delivering fuel under pressure from an inlet port 28 to an injection orifice 30. A spring 32 is interposed between a spring seat 34 and a spacing shim 36 (see FIG. 2) which abuts against the sensor 10. The spring 32 holds the needle valve 20 closed until the pressure fed to the injection orifice 30 from a pump (not shown) via the inlet port 28 rises to a level sufficient to force the needle valve back against the bias of the spring 32, whereupon injection of fuel into the combustion chamber or prechamber takes place. To allow for drainage of any fuel which enters the blind bore 24, a drain nipple 38 is provided in the nozzle holder 22.

With this arrangement, as the needle valve 20 is lifted from its seated position closing the injection orifice 30 by the pressure of the fuel supplied to the injector 12, the spring 32 is compressed, in turn, applying a compressive force to the sensor 10 which accordingly outputs a signal in accordance with the amount of compression (i.e., distance), and therefore the amount of force applied thereto.

Figure 3:
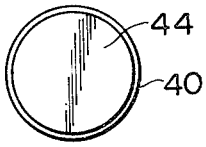
FIGS. 3 and 4 are plan and elevational views of the piezoelectric element used in the present invention.
Figure 5:
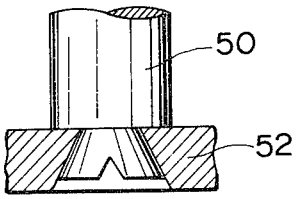
FIG. 5 is a partially sectioned view of part of the insulated contact element shown in FIG. 2.
Figure 6:
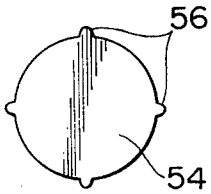
FIG. 6 is a plan view of the ground plate utilized to both ground the piezoelectric element and hold the element in place in the injector.
Figure 4:
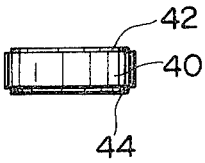
Figure 7:
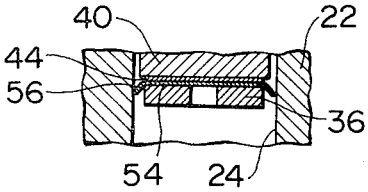
FIG. 7 is an elevational view showing the disposition of the ground plate in the injector.

FIGS. 2 to 7 show the lift sensor construction in detail. The sensor 10 takes the form of a button-like piezoelectric element 40 which is provided with highly conductive metal electrodes 42, 44. The peizoelectric element may be formed of titanic acid or lead zirconate while the electrodes may advantageously take the form of silver films applied by a vacuum evaporation process or the like. The electrodes 42, 44, as best seen in FIGS. 3 and 4, are formed to terminate short of the peripheral edge of the ceramic body constituting the piezoelectric element, and thus prevent any unwanted discharge of electricity between either of the electrodes and the wall of the blind bore in which the piezoelectric element is disposed.

An insulator 46 formed of a suitable insulating material such as glass or the like is disposed in the blind bore 24 and is arranged to project through an aperture 48 formed in the nozzle holder. An oil seal 47 is preferably disposed in the aperture to provide an oil tight seal between the insulator 46 and the aperture. Alternatively, the insulator may be bonded in place to achieve the same end. A pole-like terminal element 50 is disposed sealingly through the inslulator and is provided with a disc 52 which is staked, or otherwise connected, to one end thereof. This disc 52 is machined so as to have a flat surface which contacts the piezoelectric element electrode 42 and accordingly applies force uniformly thereto. The disc is of course dimensioned to not contact the wall of the blind bore when in position.

A ground plate or disc 54 of phosphor bronze or the like is disposed in the blind bore to contact the piezoelectric element electrode 44. This ground plate 54 has a very flat surface which contacts the piezoelectric element electrode 44. The ground plate is formed with a plurality of projections 56 which engage the wall of the blind bore to establish a good electrical connection between the ground plate and the nozzle holder 22 and to enable the plate 54 to be press fitted into the blind bore, and hence alone, secure the piezoelectric element in place. This feature is particularly apparent from FIG. 7 of the drawings wherein the projections 56 are shown deflected and firmly engaged with the wall of the blind bore. In order to adjust the force with which the spring 32 biases the needle valve 20, the shim 36 may be selected to have an appropriate thickness and thus accordingly vary the initial force applied between the sensor 10 and the valve seat. The surface of the shim in contact with the ground plate is machined to have a very flat surface to apply force uniformly to the piezoelectric element via the ground plate. The ceramic piezoelectric element, due to its nature, has a face highly resistant to stress and an opposite face susceptible to cracking under stress. The arrangement of the flat surfaces on the disc 52 and the shim 36 protects the element from being cracked by the force applied thereto during operation of the fuel injector.

Figure 8:
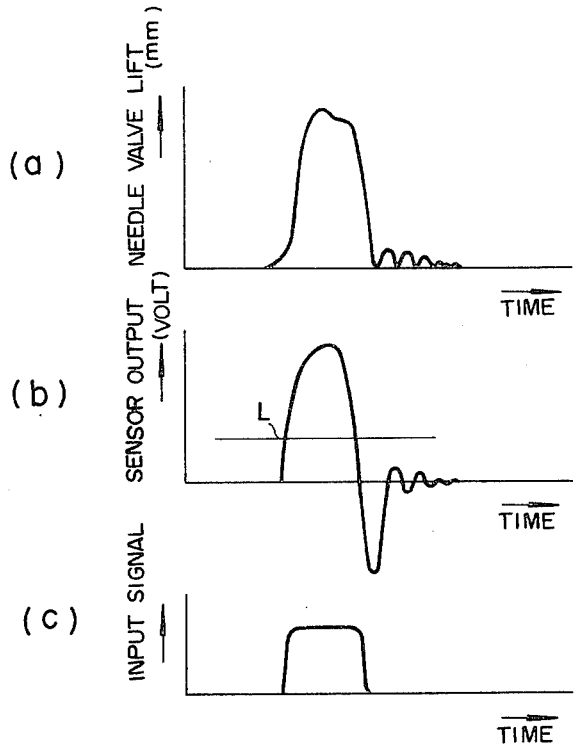
FIGS. 8*a*, 8*b* and 8*c* are graphs showing respectively (a) the lift characteristics of the needle valve of the injector in terms of lift and time, (b) the output characteristics of the piezoelectric element which correspond to the lifting of the needle valve in terms of voltage and time and (c) a signal inputted to a control circuit after being received from the sensor and shaped in a shaping circuit.

FIGS. 8*a* and 8*b* show respectively the lift of the needle valve (mm) with respect to time and the corresponding voltage output of the lift sensor with respect to time. As seen from these graphs, the output of the piezoelectric element varies with the displacement of the needle valve during the rise and fall thereof.

Figure 9:
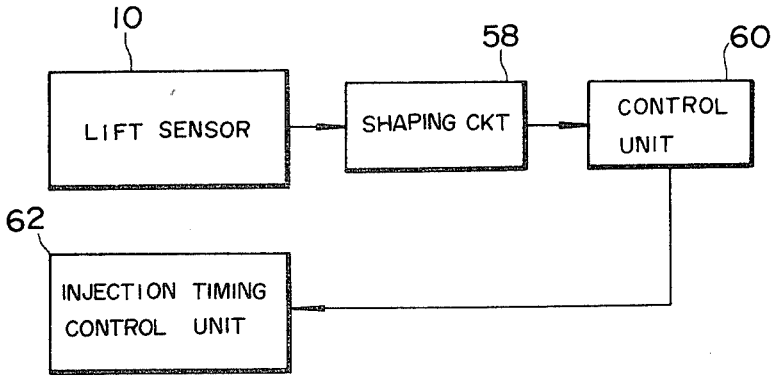
FIG. 9 is a block diagram of a possible circuit arrangement suited for use with the sensor of the present invention.

FIG. 9 shows in block diagram form a circuit suitable for use with the lift sensor of the present invention. With this arrangement, the output of the sensor (FIG. 8*b*) is fed to a shaping circuit 58 which shapes the signal above the slice level L (see FIG. 8*b*) and subsequently outputs a signal such as is shown in FIG. 8*c*. The output of the shaping circuit 58 is then fed to a control unit 60 which then issues a control signal to an injection timing control circuit 62. With this arrangement, the minor voltage fluctuations which occur at the end of each injection as a result of rebounding of the needle valve are eliminated, thus substantially eliminating any noise in the control signal fed to the injection timing control circuit.

Thus, in summary, the present invention features a simple, highly robust lift sensor arrangement in the form of a button-like ceramic piezoelectric element provided with metal film electrodes, the elements being sandwiched between members having machined flat surfaces to prevent the formation of stress cracks in the ceramic. The members (an insulated terminal member and a ground plate) both secure the piezoelectric element in place and serve to define a circuit which includes the body of the injector, thus eliminating the need for lead wires which otherwise complicate the configuration and construction of both the injection and the sensor per se. With this arrangement, manufacture, assembly and repair are inherently facilitated.

What is claimed is:

1. In a fuel injector of the type having:

a housing;

a nozzle disposed in said housing;

a valve element operatively disposed in said nozzle for controlling an injection orifice thereof;

a spring engaging said valve element at one end thereof for biasing said valve element toward a position in which said valve element closes said injection orifice;

a piezoelectric element disposed in said housing;

a lift sensor comprising:

a terminal element disposed in contact with a first side of said piezoelectric element, said terminal element being insulated from said housing and projecting out of said housing through an opening formed therein; and means interposed between said spring and a second side of said piezoelectric element for establishing electric contact between said second side of said piezoelectric element and said housing and for retaining said piezoelectric element within said housing, said means being defined by a ground plate having the form of a metallic disc having a plurality of projections extending from the periphery thereof, said projections engaging a wall of said housing to establish said electrical contact and to hold said piezoelectric element within said housing, said ground plate having a surface area nearly equal to or greater than that of said second side.

2. The apparatus as claimed in claim 1, wherein said terminal element is formed with a flat surface, said flat surface being adapted to abut said first side of said piezoelectric element so as to uniformly apply force thereto.

3. The apparatus as claimed in claim 1, further comprising a spacing shim interposed between said ground plate and said spring, said shim having a flat surface in contact with said ground plate so as to uniformly apply force to said second side of said piezoelectric element via said ground plate.

4. The apparatus as claimed in claim 1, wherein said terminal element takes the form of a terminal pole disposed through an insulating body and a disc connected to one end of said pole.

5. The apparatus as claimed in claim 1, wherein said piezoelectric element has button-like cylindrical configuration and is formed with first and second metal film electrodes on said first and second sides, respectively, said first and second electrodes being formed to terminate short of the peripheral edge of said piezoelectric element.

6. In a fuel injector of the type having:

a housing;

a nozzle disposed in said housing;

a valve element operatively disposed in said nozzle for controlling an injection orifice thereof;

a spring engaging said valve element at one end thereof for biasing said valve element toward a position in which said valve element closes said injection orifice;

a lift sensor comprising:

a piezoelectric element disposed in said housing, said piezoelectric element having a cylindrical configuration and being formed with first and second metal film electrodes on said first and second sides respectively, said first and second electrodes being formed to substantially cover said first and second sides and terminate short of the peripheral edge of said cylindrical piezoelectric element for preventing electrical discharges between said first and second electrodes and said housing;

a terminal element disposed in contact with said first electrode of said piezoelectric element, said terminal element being insulated from said housing and projecting out of said housing through an opening formed therein;

means defining a first flat surface on that portion of said terminal element in contact with said first electrode, said flat surface having a surface area nearly equal to or greater than that of said first electrode for applying a uniform force to said piezoelectric element;

a dis-shaped ground plate interposed between said spring and the second side of said piezoelectric element, said ground plate establishing electric contact between said second electrode of said piezoelectric element and said housing, and engaging said housing for retaining said piezoelectric element within said housing; and means defining a second flat surface on that portion of said ground plate in contact with said second electrode, said second flat surface having a surface area nearly equal to or greater than that of said second electrode for applying a uniform force to said piezoelectric element.

* * * * *